US005443278A

United States Patent [19]

Berto

[11] Patent Number: 5,443,278

[45] Date of Patent: Aug. 22, 1995

[54] SNOWMOBILE SKI LINER

[76] Inventor: Joseph J. Berto, 6539 Rogue River Dr., Shady Cove, Oreg. 97539

[21] Appl. No.: 121,559

[22] Filed: Sep. 16, 1993

Related U.S. Application Data

[63] Continuation-in-part of Ser. No. 2,875, Dec. 22, 1992, abandoned.

[51] Int. Cl.[6] ..... A63C 5/04

[52] U.S. Cl. ..... 280/28; 280/21.1

[58] Field of Search ..... 280/28, 28.14, 28.16, 280/21.1, 22, 22.1; 180/182

[56] References Cited

U.S. PATENT DOCUMENTS 3,675,939 7/1972 Vik ..... 280/28

5,227,749 6/1993 Bergstrom ..... 280/28

*Primary Examiner*—Richard M. Camby

*Attorney, Agent, or Firm*—Burns, Doane, Swecker & Mathis

[57] ABSTRACT

A snowmobile steering ski or skis, which may be equipped with a ski liner to prevent undue drag on a snowmobile snow, includes a integral fin that enhances steering control in turning or resisting sidehill slippage of the snowmobile particularly in traversing powder or hard packed. The ski liner fin is integral, or replaceable, and extends outwardly along the outer edge and downwardly over a central portion of the ski. The fin contacts the snow on the inner side of either a flat turn, or the uphill slope of a sidehill run, because the forward end of the snowmobile ski is cambered so as to tip downwardly toward the steered direction of a turn.

8 Claims, 4 Drawing Sheets

29
17
"A"
34
19
11
11
26
26
17
34

17
34

26
"B"
17

SNOWMOBILE SKI LINER

This is a continuation-in-part of application Ser. No. 29/002,875, filed Dec. 22, 1992 now abandoned.

This invention relates to an improvement in ski liners which reduce drag or friction of such skis used to steer snowmobiles. More particularly, it relates to an integral fin for such ski liners to improve directional control by a snowmobile steering ski, or skis, that are covered by such friction reducing ski liners. An integral fin of the present invention permits the ski liner both to execute turns or to maintain a straight path while crossing a side hill, without substantial skidding or slipping of the snowmobile from a desired track.

Further, the present fin is configured and positioned on the ski liner so that it avoids drag on the liner when a steering ski is neither executing a turn, nor crossing a side hill. Additionally, it takes particular advantage of conventional snowmobile steering systems in that such skis are normally turned by an operator through handle bars or a steering wheel which rotates a spindle or spindles secured to the ski so that its lower end is canted, or angled, forward relative to the snowmobile. In such an arrangement the spindle connection to the ski is usually at the center of the relatively straight or tracking portion of the ski. Thus, when the ski is turned, it likewise rolls laterally into the turn so that the turned edge of the ski is lowered in proportion to the radius of the turning curve.

In the present invention, the liner fin uses such tilting to advantage, particularly on hard packed or deep powder snow, by progressively engaging the fin along its longitudinally tapered, lower edge so that rear end contacts snow first and then as the turn radius decreases the fin edge increases a desired directional drag on the ski and the snowmobile. Thus, the desired reduction of drag on the ski, as provided by the liner, is automatically counteracted by the fin only when it is desirable to prevent slipping or skidding, either during a required turn on ice or deep snow, or while maintaining a desired course on a side hill run on similar terrains.

In accordance with the present invention, such a fin is formed with, or attached to, an upper edge of a ski liner which substantially encases the ski's sliding surface that contacts snow and so that the fin extends fore and aft of the ski connection to the steering spindle. Additionally, the fin preferably extends above and outwardly from a substantially central part of the flat or tracking portion of the ski. The level of the fin's lower edge is sufficiently above the base of the ski so that in normal forward propulsion such lower edge is well above the normal surface of packed snow. Thus, the fin only comes into action when required to counteract the reduced friction effect of a liner on snow so that the fin prevents side slip during normal turning or on side hill runs in deep powder or on hard packed or icy snow.

Because turning of the ski lowers the prow, the ski also brings the fin of this invention, which extends along the upper edge of the ski, down into direct contact with the snow surface so that it substantially increases frictional contact along the length of the ski. At the same time, normal straight-forward movement of a ski liner is not hindered by increased friction over the balance of the ski liner. Accordingly, the intended function of improving the speed of a snowmobile ski through the snow is not inhibited in normal operation on flat terrain or turning in normal snow, but on the other hand, in deep or hard packed snow, the fin improves both traction on each turn and prevents side slipping on tilted terrains.

In preferred embodiments of the present invention, the ski liner may be formed in a single mold, so that it includes the fin as an integral part thereof. Alternatively, it may be a replaceable unit, either directly secured to the ski, or to the liner, or both. A particular advantage of forming all or the outer edge of the fin as a separate element, is that it can readily be replaced if all or a portion of the fin is damaged in turning on cement, asphalt, rocks, and the like.

In accordance with broad aspects of the invention, the ski liner having such a fin or fins improves side hill traction and directional control of a snowmobile in deep powder or on hard pack snow where such liner is fitted to a steering ski that has an upwardly tilted prow and an elongated tracking surface, with the ski itself being turned through a spindle connection by handle bars or a steering wheel, and such spindle is connected so that it simultaneously tilts the ski laterally as it turns the ski. By such an arrangement, the ski is canted or cambered so that the ski rolls to the left or right, depending upon the direction of the turn. Further, when such a ski is covered by a ski liner that is desirably formed in a single plastic molding, the liner not only covers the lower surface of the ski, but also conforms to the upwardly curved sides of the ski. Thus, the liner effectively encloses the ski from the prow through the trailing section of the elongated tracking surface. With such configuration, a fin member extends primarily along and above the tracking surface. The exterior surface of the liner is generally uniformly convex across the ski and along the length of the ski. Further, upper edges of the convex portion are generally parallel to and above the central portion of the ski. Thus, the liner's upper edge runs generally parallel to the ground riding surface of the ski and extends fore and aft of the connection to the turning spindle. According to the present invention, the fin then extends laterally outwardly and downwardly from the upper parallel edge of the liner. Thus, the fin flares outwardly and approximately parallel to the side of the ski liner so that the ground-engaging edge extends downwardly along its length and generally parallel to and a short distance above the snow surface.

It is to be noted the fin may be either an independent part that is attachable to the ski or removably attachable to an upper edge of the liner. Desirably, an upper portion of the fin is formed as an integral part of the liner. Further, the lower edge of the fin may be formed as a "shoe" or cover that is replaceable if damaged by abrasion or impact. In any of the alternate configurations, the fin generally runs parallel to the ski under normal running conditions for the snowmobile, but in hard packed, or deep snow, the fin engages the snow upon steering rotation of the ski, whether turned by the handle bars or steering wheel or to prevent side hill slipping. Thus, the lower edge of the fin directly engages the snow or other terrain and thereby prevents the snowmobile from laterally sliding on a side hill, or prevents slipping during a deliberate turn in adverse snow conditions.

In a desired form the fin extends approximately one third to one half ahead of the spindle connection, and about two thirds to one half to the rear of the spindle connection. Also in accordance with the invention, the plastic composition of the ski liner itself, and if the fin is integrally formed therewith, is an ultra high molecular weight (UHMW) polyethylene. Further, desirably the fin is tapered along its longitudinal length so that the depth of the fin at the rear of the ski, that is, the portion extending along the trailing edge, is slightly deeper than the front end. In this way the fin thereby engages the snow in an amount proportional to the degree of turn, or the degree of side slipping of the snowmobile on hard packed or soft snow.

Further objects and advantages of the present invention will become apparent from the following detailed description, taken in conjunction with the accompanying drawings, which form an integral part of the specification.

IN THE DRAWINGS

FIG. 1 is a perspective view of a snowmobile, as illustrated in phantom, to which the present invention has been applied, but more particularly it shows in full-line an integral fin on each of a pair of ski liners, respectively connected to one of the dual steering skis of such a snowmobile.

FIG. 2 is a detail exploded perspective view of a portion of the snowmobile of FIG. 1, showing a typical suspension system for one of the steering skis and a ski liner including a fin of the present invention. This view also show a studded bar and skags for securing the liner to the ski, and also illustrates a typical spindle connection between one of the skis and the snowmobile steering arrangement.

DESCRIPTION OF THE PREFERRED EMBODIMENTS OF THE INVENTION

Figure 1:
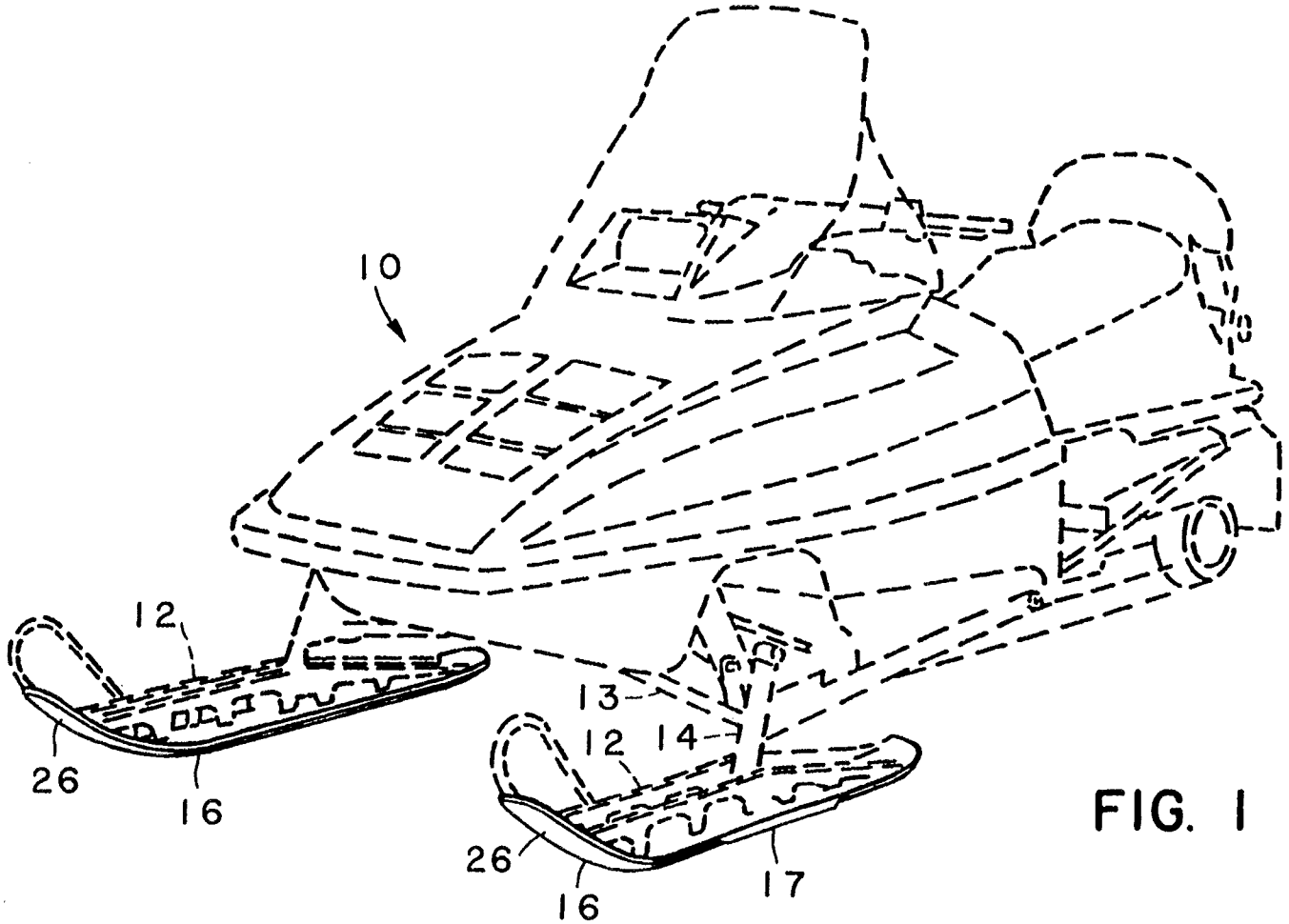

As indicated in a perspective view by FIG. 1, snowmobile 10 includes a pair of turning or steering skis 12, as shown in outline, and illustrates a preferred embodiment of my invention, including ski liner 16 and an integral fin 17. In this embodiment, snowmobile steering skis 12 are turned simultaneously by a steering mechanism which includes a tie bar 13 that rotates spindles 14, for "dual steering" in response to turning of handle bars or a steering wheel (not shown). Both skis are adapted to rotate not only in a plane parallel to the base of the snowmobile 10, but also so that they roll laterally in the direction of the turn imposed by the steering arrangement or gravity. Because snowmobile skis 12 are generally formed of metal, they increase resistance to movement of the snowmobile through snows of various densities. It has been found desirable to decrease such frictional resistance to improve its speed, particularly in the sport of snowmobile racing. Accordingly, ski "liners" 16 are used to cover the friction surfaces of snowmobile skis 12. Such ski liners are generally formed of a high density polyethylene or polypropylene so that the liner is mechanically strong and flexible and at the same time has a low coefficient of friction on snow or ice.

Figure 2:
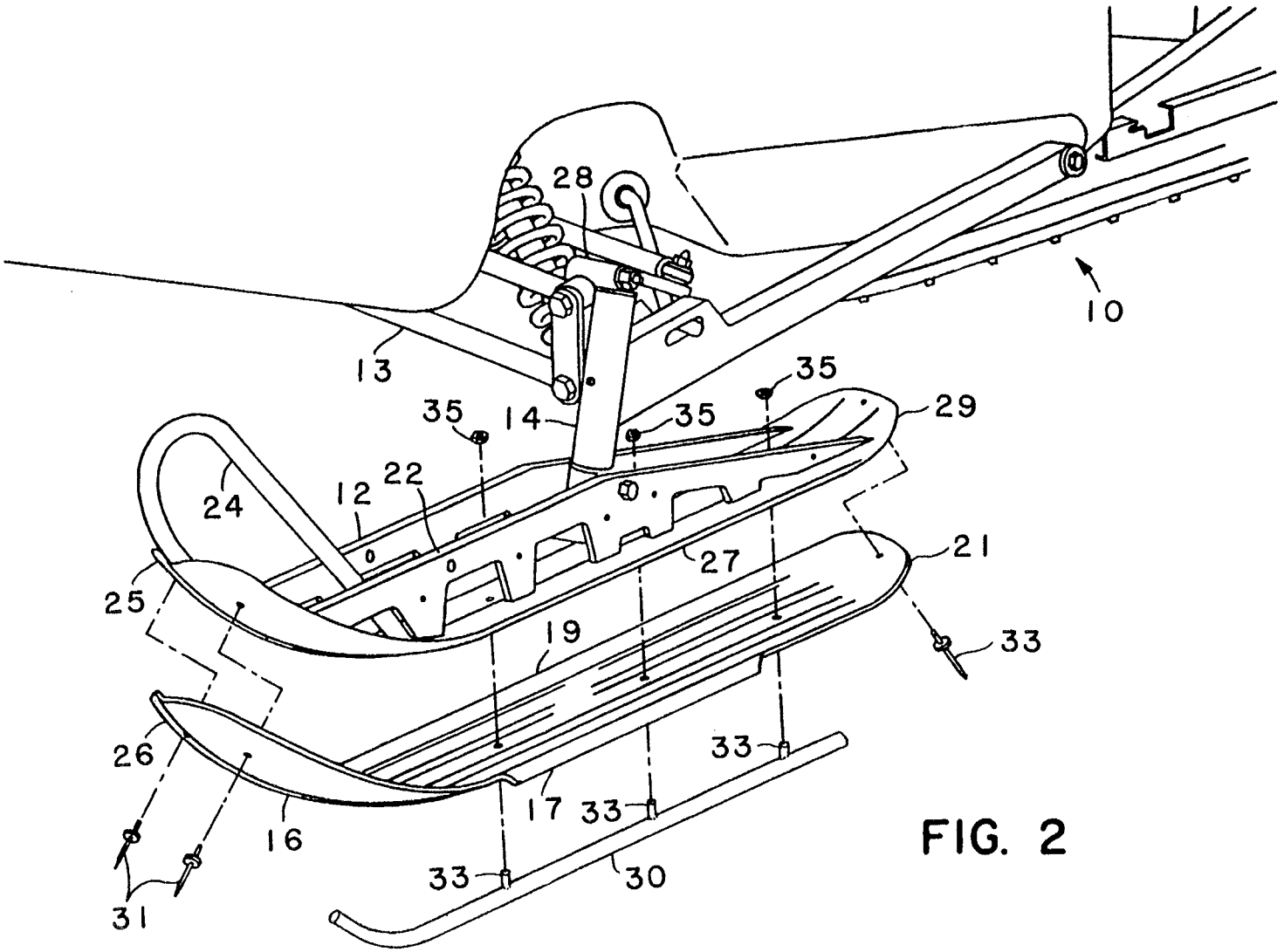

FIG. 2 shows in an exploded view details of construction of ski 12 and its interconnection with spindle 14, together with a suitable arrangement for attaching liner 16 to the ski so that it substantially covers all snow engaging surfaces of the ski. It further illustrates in greater detail a preferred arrangement of fin 17 along the upper outboard edge of liner 16 so that the lower edge of fin 17 is above the primary running surface of ski 12, as seen in FIG. 1. In the illustrated configuration, only one fin 17 is provided on each liner 16. If a single steering ski is used on the snowmobile, it will of course be understood that a fin 17 is required on both sides of liner 16. However, in the present case, fin 17 extends along the right hand side of the outboard edge of ski 12. A similar fin 17 on the other dual ski liner, as shown in FIG. 1, would be above the left hand, outboard edge of such other ski liner, as viewed from the front of the machine in FIG. 1.

Means for attaching ski 12 to turning spindle 14 is also shown in FIG. 2. It will be noted in this regard that center or "backbone" of the ski is reinforced along its length by bridge member 22. Bridge 22 also includes a support loop 24 extending behind the center of prow portion 25 of ski 12. It will also be noted that bridge or backbone 22 provides a suitable attachment for connecting the fully assembled ski 12 to spindle 14. As shown, steering knuckle 28 and tie bars 13 are interconnected to the steering mechanism (not shown) in an arrangement similar to automobile steering systems. Spindle 14 is canted forward by its lower end, as shown, and is connected to ski 12 at an angle that will camber the ski during turning so that the ski rolls laterally relative to the direction of travel. This is particularly significant in the present invention because such turning of ski 12 brings the lower edge of fin 17, carried by liner 16, into, or out of, engagement with surface terrain. Thus, depending upon the desired change in direction of travel, or to maintain the snowmobile on a straight path when traversing a side hill, and particularly where the terrain is covered with deep snow or the surface is icy or hard packed, the roll of ski 12 automatically brings fin 17 into or out of frictional engagement with the snow.

As indicated in FIG. 1 and 2, front portion 26 of ski liner 16 covers virtually the entire running surface of prow 25 of ski 12. The trailing or tracking surface of liner 16 then closely conforms to the bottom contour of ski 12 throughout trailing or tracking portion 27 and extends to an upswept section 21 adjacent to rear end 29 of ski 12, which turns slightly upwardly. Desirably, the inner surface of liner 16 closely approximates the outer configuration of ski 12 when the two are bolted together. Connecting means, such as a pair of skags 31 penetrate prow 26 of liner 16 near the front or prow end 25 of the ski, to cover prow section 25 with liner section 26. At least a single skag 33 binds rear end 29 of the ski 12 with the trailing end of liner 16. As indicated by the drawings, skags 31 and 33 are screw threaded rods that include pointed pitons, that are effective as "picks" on icy, packed snow, or other hard surfaces, and are particularly useful in their illustrated positions to assist sharp turns to the left or right, or on steep side hill runs.

Central portion 19 of liner 16 is securely clamped by bar 30 along the length of central traveling or trailing portion 27 of ski 12. Bar 30 includes a plurality of studs 33, in this instance 3, which extend through bolt holes in both the liner and ski and are secured against the inner surface of portion 27 of ski 12 by nuts 35. As also best shown in FIG. 2, fin 17 is slightly tapered in width from prow or front end 26 of ski liner 16 toward end section 21. Outer edge 34 of fin 17 is generally parallel to central portions 19 and 27, but is laterally displaced, or flared, outwardly from liner 16. Such flare is particularly shown in detail in elevation by FIGS. 9, and in end view by FIG. 10.

FIGS. 3 to 8 inclusive, show a preferred form of liner 16 and more particularly, show the configuration and relationship of fins 17 to the side wall construction of tracking portion 19 of the liner 16.

Figures 3, 4, 5, 6, 7, 8:
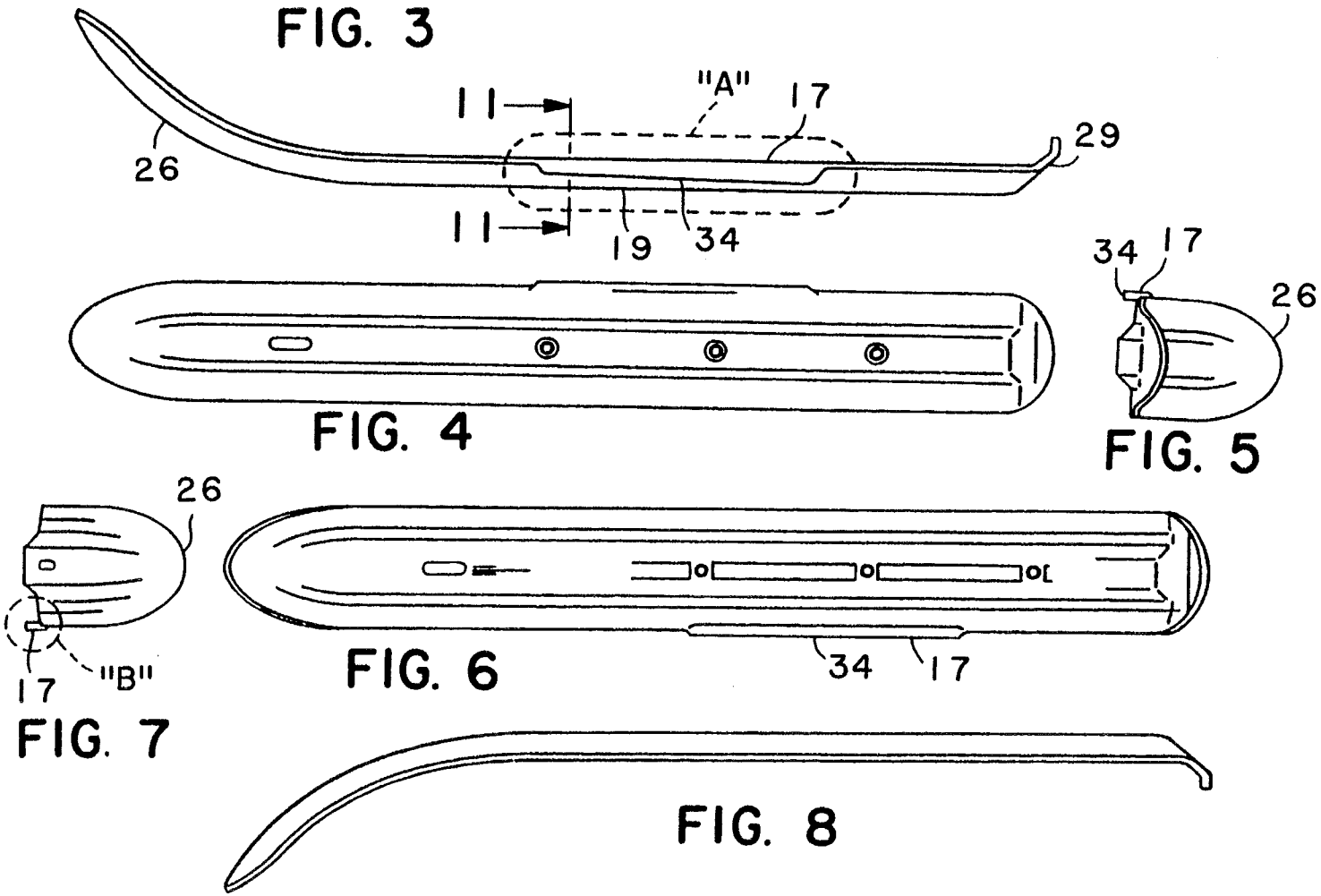
FIG. 3 is a side elevation view of the integrally tinned ski liner of FIGS. and 2 and particularly illustrates the fin member as indicated within the dashlines of the oval, designated as "A".
FIG. 4 is a bottom plan view of the ski liner of FIG. 3.
FIG. 5 is an end elevation view of the liner of FIG. 4, as viewed from the trailing end of the ski liner.
FIG. 6 is a top plan view showing the interior of the ski liner of FIG. 4.
FIG. 7 is an end view of the ski liner of FIG. 6, taken from the prow end of the ski liner.
FIG. 8 is an elevation view of the opposite side of the liner shown in FIG. 3.

FIG. 3 is a fight side view (as shown in FIGS. 1 and 2) of liner 16 with a single fin 17 in its normal operating position for attachment along the fight side of a ski, as seen from the front of snowmobile 10 in FIGS. 1 and 2.

FIG. 4 is a bottom view of liner 16, showing the snow engaging surface.

FIG. 5 is an end elevation view looking from the fight end of the liner, as shown in FIG. 4.

FIG. 6 is a top plan view looking down upon the inner or ski engaging surface of liner 16, as shown in FIG. 3.

FIG. 7 is an elevation view looking in the direction of prow portion 26 and from the left end of FIG. 6.

FIG. 8 is an elevation view of the opposite side of liner 16 as shown in FIG. 3.

Figure 9:
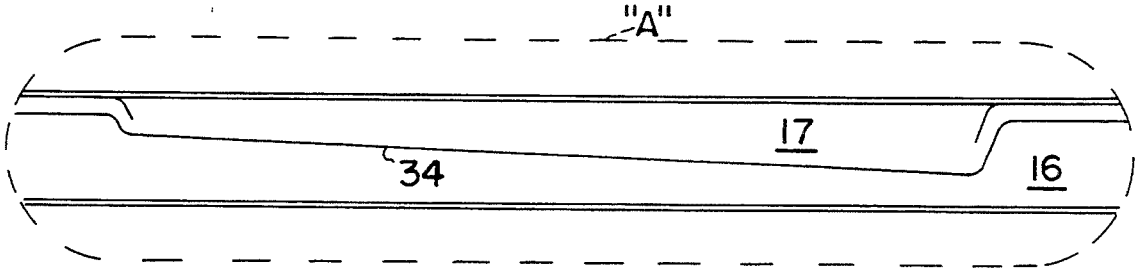
FIG. 9 is an enlarged, partial side elevation view of the fin of FIG. 3 showing details of the fin within the oval designated as "A".
Figure 10:
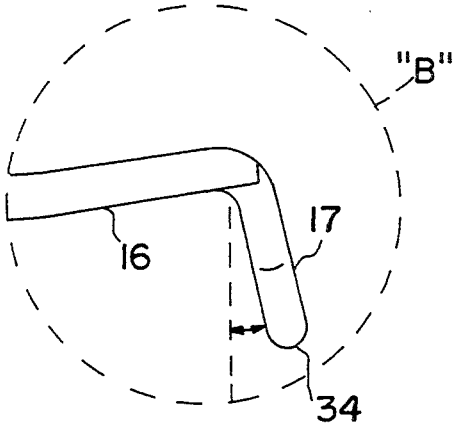
FIG. 10 is an enlarged portion of the liner as shown in end view FIG. 7 which further illustrates details of the fin, marked by the dashed circle designated as "B" in FIG. 7.

FIG. 9 shows a partial elevation view of fin 17, seen as an enlargement of liner 16, as enclosed by dotted lines and designated as "A" in FIG. 3. Such a side view of fin 17 illustrates a particularly useful configuration of the fin where it is integrally formed during casting or molding of liner 16. As mentioned, the length of fin 17 is tapered so that terrain engaging edge 34 increases in depth, or vertical height, from the forward end to the trailing end of liner 16. As best seen in FIG. 10, which is an enlargement of the enclosed portion of FIG. 7, designated as "B", edge 34 extends further outwardly and downwardly from the top edge of liner 16. This configuration is particularly desirable because tilt or roll of ski 12 during a turn gradually increased the breaking force, or slide resistant action of fin 17, as the ski turns edge 34 more sharply downward during a lateral turn. Thus, the rear end of fin 17 engages the snow first and as the turning radius decreases the lower edge 34 of fin 17 progressively and more fully engages the forward portion of edge 34 with the terrain. The same action of course occurs in traversing a side hill and the amount of engagement of edge 34 with the ground will depend on the angle between the snowmobile and the ground snow. As more generally shown in FIGS. 1 and 2, it will be seen that edge 34 of fin 17 is disposed along the upper side wall of liner 16 so that approximately half the length of fin 17 is ahead of the ski's connection to turning spindle 14, and the other half behind.

Figure 11:
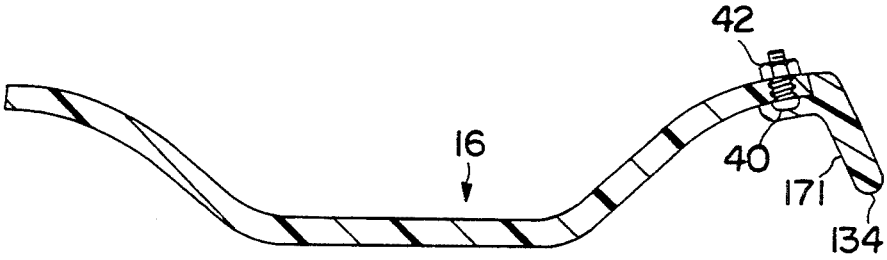
FIG. 11 is a cross-sectional view taken in the direction of arrows 11—11 in FIG. 3 which illustrates an alternate arrangement for separately attaching or detaching a fin directly to the ski liner.
Figure 12:
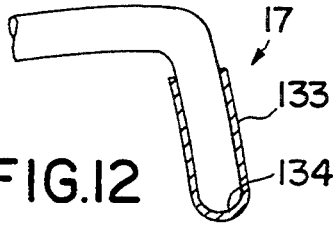
FIG. 12 illustrates a portion of the fin of FIG. 10 in cross section showing a form of an attachable/detachable cover or "shoe" over the lower edge of the fin.

FIG. 11 shows a cross-sectional view of liner 16 taken in the direction of arrows 11—11 in FIG. 3, an alternate embodiment of the present invention. In this embodiment a replaceable fin 171 is suitably attached to liner 16 directly under the upper outboard edge of ski liner 16. Such attachment may be made by a plurality of threaded lugs 40, embedded in fin 171, and a bore extending through outer edge 44, and nuts 42. Alternatively, terrain engaging edge 134 of fin 171 may be formed of abrasion resistant materials, such as carbaloy, or a mixture of UHMW polyethylene and carbaloy particles. Ground engaging edge 134 may also be formed as a readily replaceable metal shield 133 which extends around and along the full length of edge 134, as indicated in FIG. 12.

Alternatively, fin 171 may be attached directly to liner 16 through bolts or nuts molded into the upper edge of liner 16 or using ordinary screws for attaching the fin directly to liner 16 (not shown).

In summary, it will be seen that the present invention provides a ski liner that improves side hill traction or directional control by a steering ski of a snowmobile, but which in normal operation reduces the drag of the steering ski and thus increase the speed of a snowmobile at the same amount of power. Such increased control on side hills or in turning is accomplished by providing a fin member extending along and above the elongated tracking surface of a liner covering the relatively straight, flat portion of the ski. As so positioned, on a side wall of a ski liner which encloses the ski tracking surface, the fin extends fore and aft of the connection of a steering ski to the steering, or turning, spindle and extends laterally downwardly and outwardly so that the ground engaging edge of the fin is parallel to the longitudinal side of the liner. Thus, the fin edge is in general parallel to the longitudinal portion of the ski, but sufficiently outboard of the liner so that the fin is lowered laterally by turning of the steering spindle until the edge contacts the snow, ice or other terrain when the snowmobile is tipped or turned.

Where the snowmobile has only a single steering ski, it will be apparent that the ski liner will include two parallel fins, one on each side of the liner and along the upper edges of the generally convex configuration of the liner. Additionally, the fins will be of equal length and similarly positioned relative to the steering spindle. In this way, whether the snowmobile is traversing a slope that rises along either its left or its right side, the fin on the uphill side will prevent side slip. And the same effect is available during turning to resist the tendency of a ski liner to take the snowmobile directly ahead rather than around a desired turn, or to overcome the inability of a steering ski liner to maintain a snowmobile on a straight course across a side hill run.

While various modifications and changes will occur to those skilled in the art from the foregoing detailed description, all such modifications or changes that come within the following claims are intended to be included therein.

I claim:

1. Apparatus for improving side hill traction and directional control of a snowmobile during traverse of deep powder, or hardpacked, snow, said snowmobile having a steering ski that includes a friction reducing liner covering a substantial portion of the terrain engaging surface thereof, said ski having an upwardly tilted prow and an elongated tracking surface, and wherein said steering ski is both turned and pivoted by a turning spindle tilted rearwardly from its connection to said ski toward said snowmobile so that the camber of said steering ski changes the turning radius in response to directional turning of said snowmobile;

said apparatus comprising a steering ski liner formed as a plastic molding having inner and outer surfaces generally conforming to and generally covering a substantial portion of the steering ski prow and the elongated terrain tracking surfaces thereof so that the outer surfaces of said liner is generally convex transversely over the length of said ski, and the upper longitudinal edges of said liner terminating above the ski terrain tracking surface, and at least one of said longitudinal edges supporting a fin member cantilevered from said edge to extend independently outwardly, downwardly and generally parallel to said one edge so that from $\frac{1}{3}$ to $\frac{1}{2}$ of the length of said fin extends forwardly from the connection of said steering ski to said turning spindle and so that the lower edge of said fin member forms a snow or ice engaging blade generally above the terrain engaging portion of said ski liner, and said lower edge of said blade being tapered along its length with the forward portion higher than the rearward portion so that the rearward portion of said blade initially contacts the terrain and then the forward portion of said blade progressively increases contact with the terrain in response either to a reduction in the turning radius of said ski, or to compensate for inadvertent tilting of the snowmobile while traversing a side hill, or both.

2. A ski liner in accordance with claim 1 wherein the length of said fin member extends forwardly along said longitudinal edge of said liner to lie parallel to a portion of the prow of said ski and rearwardly along said longitudinal edge the same distance from said steering spindle.

3. A steering ski liner in accordance with claim 1 wherein the plastic composition of at least said fin member is UHMW polyethylene.

4. A steering ski liner in accordance with claim 1 wherein said terrain engaging blade of said fin member is tapered with the depth thereof increasing from the forward end of said liner toward the trailing end thereof.

5. A steering ski liner in accordance with claim 1 wherein said fin member is molded integrally with said ski liner.

6. A steering ski liner in accordance with claim 1 wherein said at least one edge includes means for disconnectably attaching the length of said fin member to said edge of said liner to permit replacement or substitution of a different fin member along said at least one edge of said liner.

7. A steering ski liner in accordance with claim 6 wherein the terrain engaging portion of said fin member is formed of an abrasion resistant material.

8. In an article of manufacture for improving turning or reducing side hill slippage of a snowmobile having a liner for reducing friction between a snowmobile steering ski and snow or ice covered terrain, wherein said liner is a single plastic molding closely covering a portion of the steering ski surface including a forward upwardly turned prow portion, an upwardly turned side portions and a rearwardly trailing, tracking portion, the improvement which comprises at least one fin member integrally fixed along a portion of one of the upper edges of said upwardly turned side portions of said liner, said fin member being cantilevered to extend independently downwardly, and parallel to said one upper edge so that from $\frac{1}{2}$ to $\frac{1}{3}$ of said fin member extends forward from the connection between a turning spindle and said steering ski for controlling the direction of a snowmobile, and said fin member having a distal edge forming a blade tapered along its length with the forward end thereof at a higher level above the terrain engaging surface than the rearward extending blade portion whereby the friction between said fin member and the terrain increases in accordance with a decrease in the steering radius or an increase in slope of a side hill being traversed by the snowmobile.

* * * * *